US008678135B2

(12) United States Patent
Crook et al.

(10) Patent No.: US 8,678,135 B2
(45) Date of Patent: Mar. 25, 2014

(54) AERIAL WORK APPARATUS WITH LATERALLY OFFSET WORK PLATFORM

(75) Inventors: Gary Crook, Fresno, CA (US); Richard Spencer, Fresno, CA (US)

(73) Assignee: California Manufacturing & Engineering Co., LLC, Kerman, CA (US)

( * ) Notice: Subject to any disclaimer, the term of this patent is extended or adjusted under 35 U.S.C. 154(b) by 33 days.

(21) Appl. No.: 13/344,526

(22) Filed: Jan. 5, 2012

(65) Prior Publication Data

US 2012/0186908 A1 Jul. 26, 2012

Related U.S. Application Data

(60) Provisional application No. 61/435,020, filed on Jan. 21, 2011, provisional application No. 61/454,544, filed on Mar. 20, 2011.

(51) Int. Cl.
*E06C 1/54* (2006.01)

(52) U.S. Cl.
USPC ..... 182/69.6; 182/62.5

(58) Field of Classification Search
USPC ..... 182/69.5, 69.6, 69.4, 63.1, 62.5; 187/269; 254/122
See application file for complete search history.

(56) References Cited

U.S. PATENT DOCUMENTS

| | | | | |
|---|---|---|---|---|
| 3,509,965 | A | 5/1970 | Mitchell | |
| 3,638,757 | A * | 2/1972 | Sampson | 182/69.6 |
| 5,381,872 | A * | 1/1995 | Peruzzi et al. | 182/63.1 |
| 5,868,218 | A * | 2/1999 | Lawson | 182/69.6 |
| 7,004,286 | B2 * | 2/2006 | Fredette | 182/62.5 |
| 2005/0056484 | A1 | 3/2005 | Fredette | |
| 2008/0105498 | A1 * | 5/2008 | Perkins | 187/269 |

FOREIGN PATENT DOCUMENTS

| | | | |
|---|---|---|---|
| EP | 0 624 500 | A1 | 11/1994 |
| FR | 2 703 673 | A1 | 10/1994 |
| GB | 1 504 969 | | 3/1978 |
| JP | 2011 032083 | A | 2/2011 |

* cited by examiner

*Primary Examiner* — Katherine Mitchell
*Assistant Examiner* — Kristine Florio
(74) *Attorney, Agent, or Firm* — W. Norman Roth

(57) ABSTRACT

An aerial work apparatus comprising a mobile chassis having a longitudinal centerline, a lift mechanism such as a scissors lift having a lower end connected to the chassis and an upper end which supports a work platform. The work platform has a longitudinal centerline which is laterally spaced from and parallel to the longitudinal centerline of the chassis such that the platform is laterally offset relative to the chassis and lift mechanism for substantially stabilizing the apparatus when handling heavy loads positioned at one side of the platform.

12 Claims, 6 Drawing Sheets

AERIAL WORK APPARATUS WITH LATERALLY OFFSET WORK PLATFORM

CROSS REFERENCE TO RELATED APPLICATIONS, IF ANY

This application claims priority from and incorporates the teachings of U.S. Provisional application No. 61/435,020 filed Jan. 21, 2011 by Gary Crook and U.S. Provisional application No. 61/454,544 filed Mar. 20, 2011 by Gary Crook and Richard Spencer.

BACKGROUND AND PRIOR ART

1. Field of the Invention

The present invention relates to aerial work apparatus having a raisable work platform for use in construction, warehouses and other tasks and environments. Frequently, relatively heavy loads such as sheets of glass are loaded onto one side of the work platform and must be elevated creating an unbalanced and potentially dangerous situation as the load is lifted.

2. Description of the Related Art

Conventional aerial work platforms, particularly relatively narrow types such as scissor lifts of width 48" or less typically have a work platform of about the same width as the supporting base or chassis. Larger scissors lifts usually have a platform width less than the width of the base. Although larger platforms provide more work space, when handling heavy loads such as sheets of glass positioned along one lateral side of the platform, stability problems occur. This is ordinarily overcome by using machines with outriggers to level the machine but not only does the work platform have to be lowered and stowed when the machine is moved to a new location, the outriggers must also be retracted and reset. There is also a significant increase in cost to include the outriggers.

A stable apparatus is needed for lifting and handling relatively heavy loads such as sheets of glass loaded onto one side of the work platform without the use of outriggers or the like.

SUMMARY

Disclosed herein is an aerial work apparatus comprising a mobile chassis having a longitudinal centerline which extends in a first vertical plane. The chassis is preferably a wheeled vehicle in which a lift mechanism, depicted herein as a scissors lift mechanism, has a lower end connected to the chassis and a work platform supported at an upper end of the lift mechanism. The work platform has a longitudinal centerline which extends in a second vertical plane which is laterally spaced from and parallel to the first vertical plane such that the platform is laterally offset relative to the chassis. Preferably, the platform has a generally rectangular deck and guardrails at lateral sides. A sheet rack may be provided at one lateral side of the work platform.

The outermost extent or edges of the chassis defines a first footprint when projected onto a horizontal plane. The outermost extent of the work platform and sheet rack defines a second footprint. Preferably for best stability, a vertical projection of the second footprint lies entirely within the boundary of the first footprint although the second footprint may in some instances extend partly outside the boundary of the first footprint. In any event, the loaded platform is substantially balanced over the chassis and lift mechanism despite a substantial proportion of the weight being located near one lateral edge of the work platform.

DESCRIPTION OF THE PREFERRED EMBODIMENTS

Figure 1:
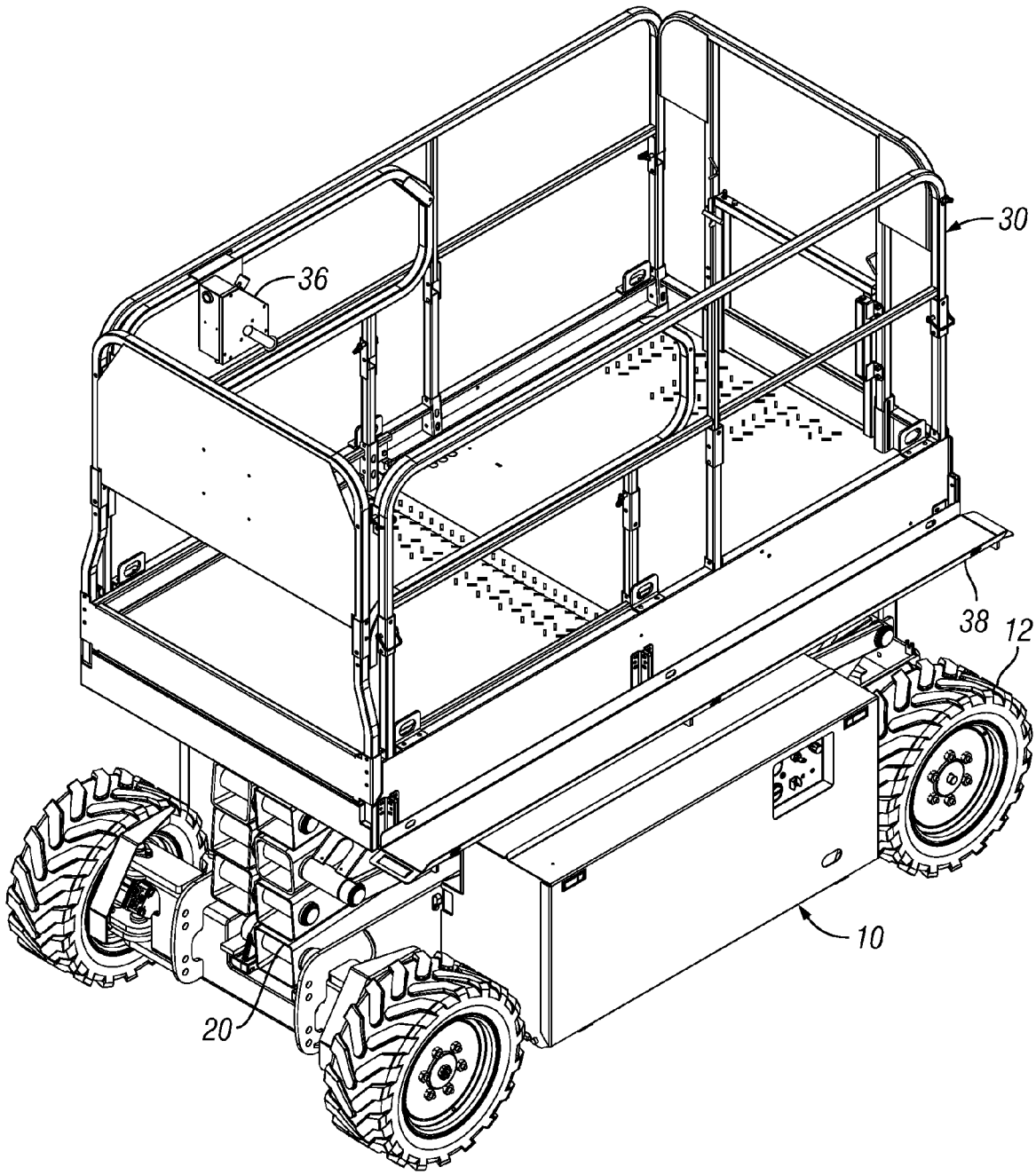
FIG. 1 is a perspective view of an aerial work apparatus having a laterally offset work platform.
Figure 2:
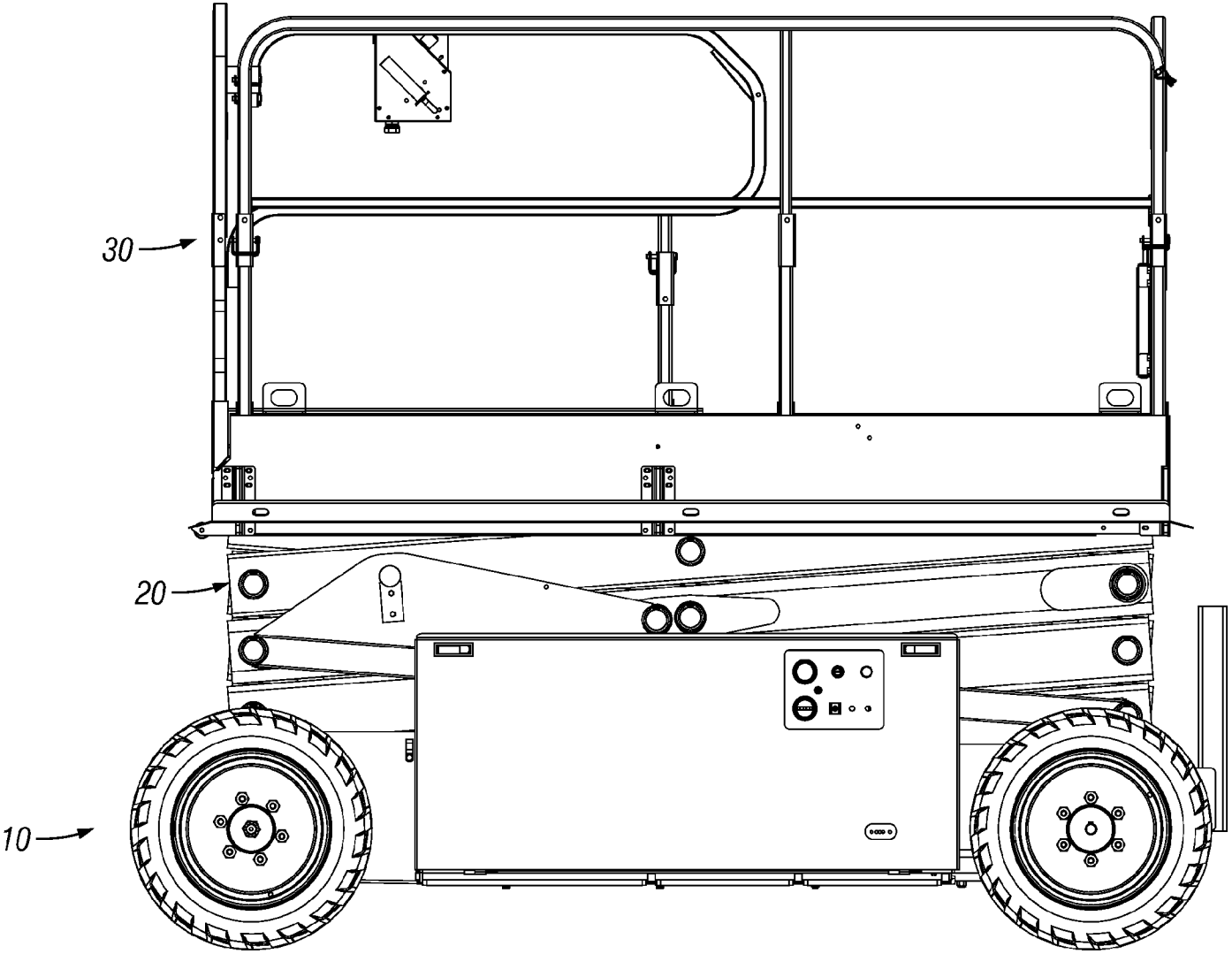
FIG. 2 is a side elevation view of the apparatus shown in FIG. 1.
Figure 3:
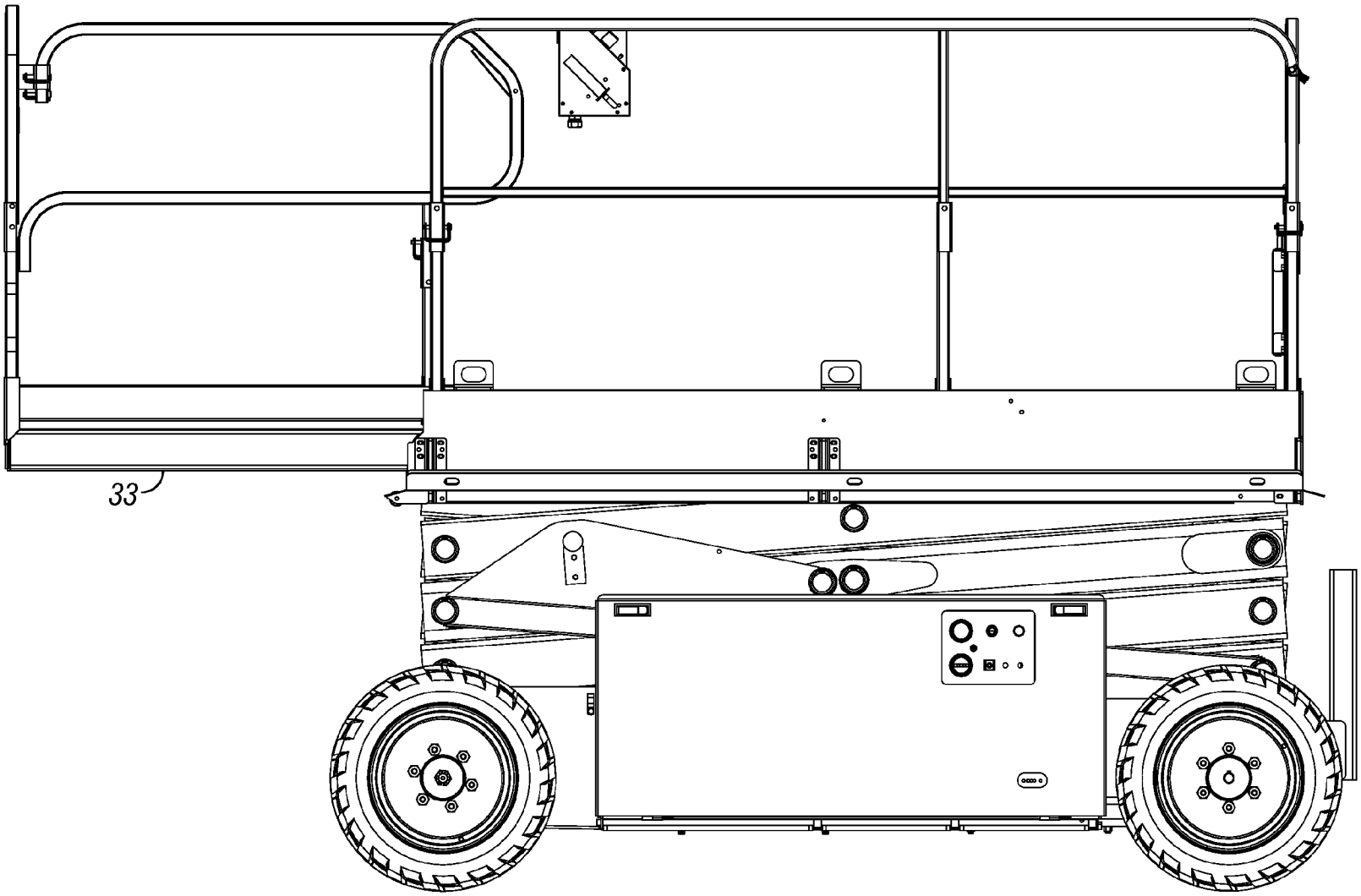
FIG. 3 is a side elevation view of the apparatus of FIGS. 1 and 2 showing an optional sliding platform deck in extended position.
Figure 4:
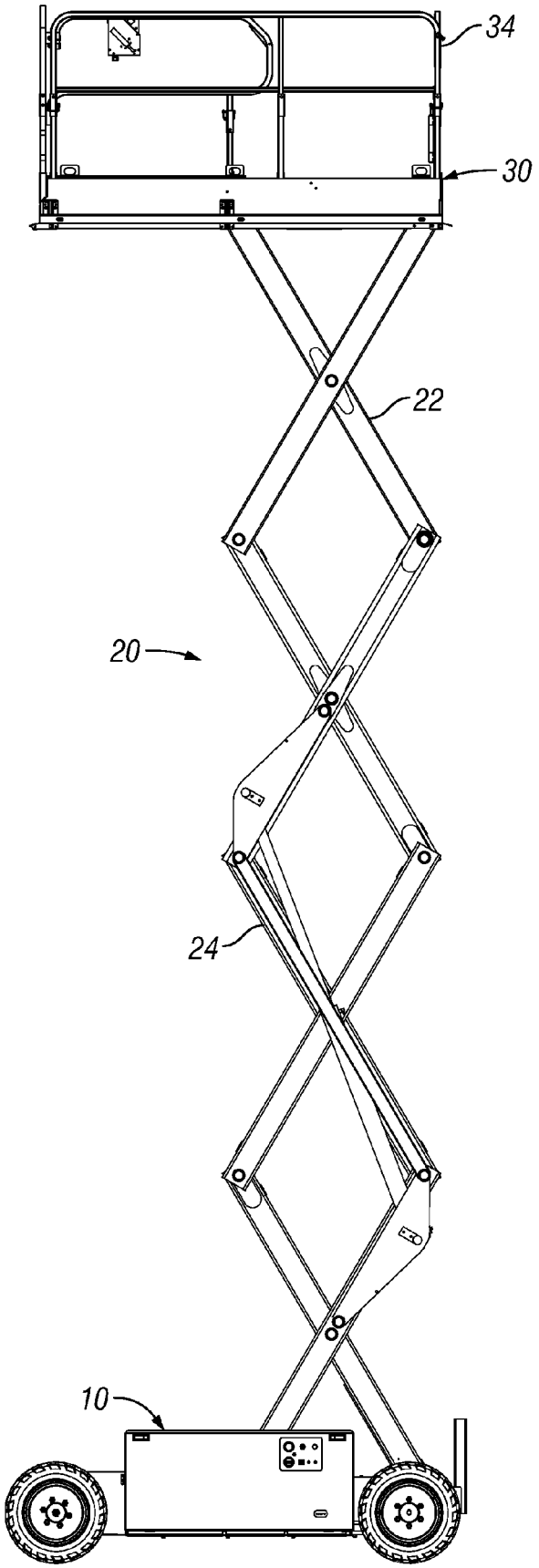
FIG. 4 is a side elevation view of the apparatus showing the platform in an elevated position.
Figure 5:
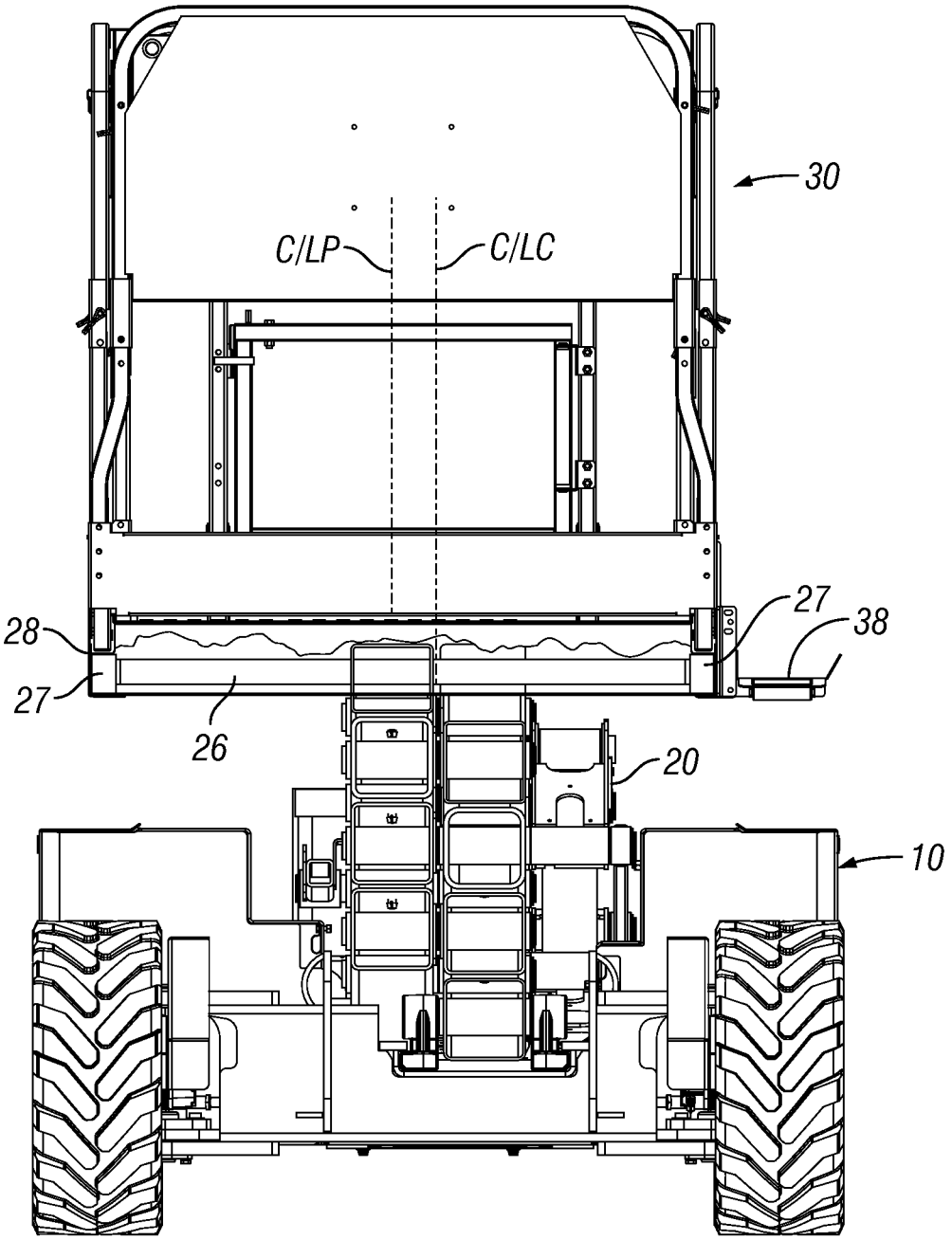
FIG. 5 is an end elevation view of the apparatus, partly broken away to show support of the platform on the lift mechanism.
Figure 6:
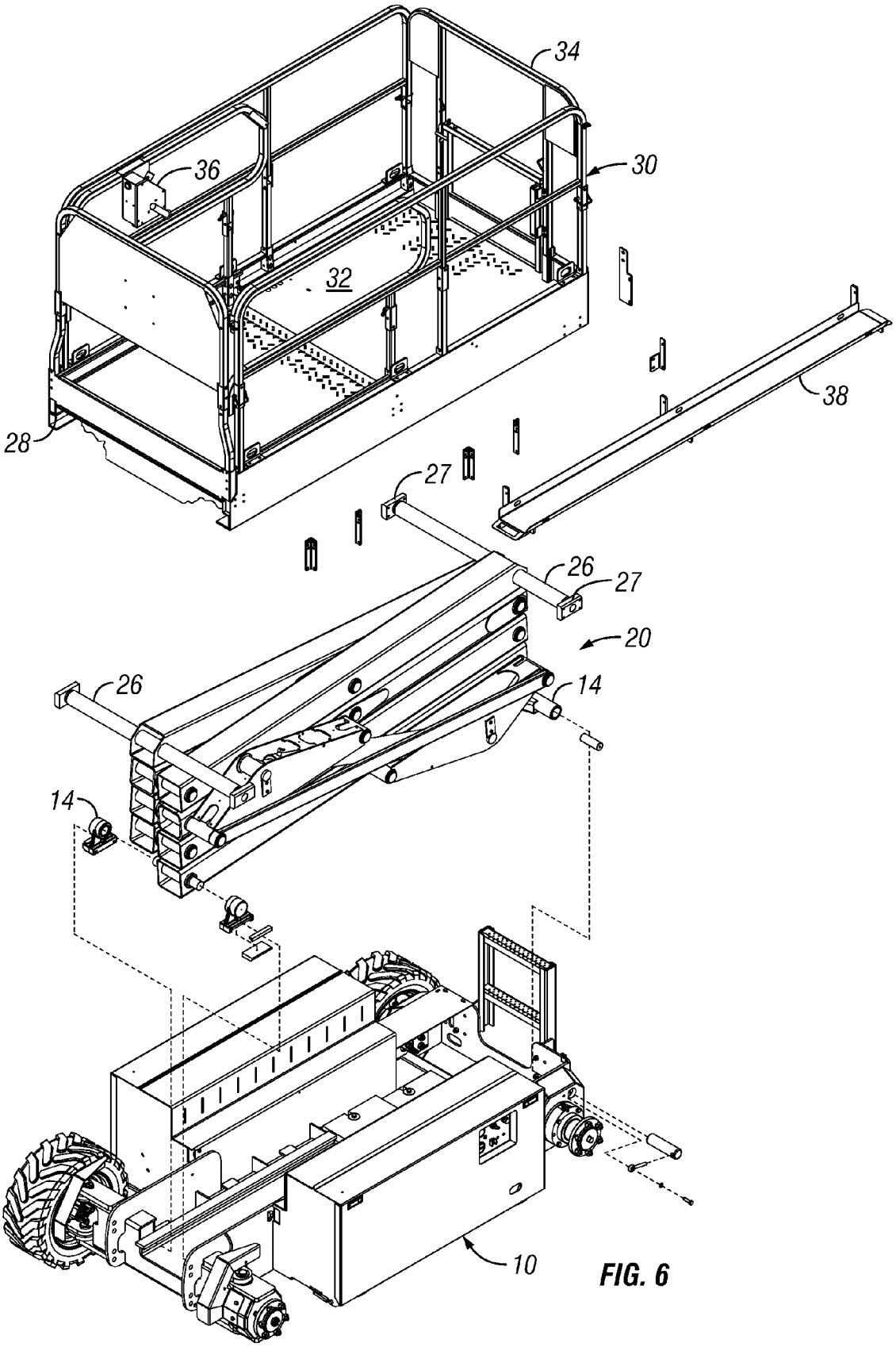
FIG. 6 is an exploded perspective view, partly broken away, showing various parts of the apparatus.

The apparatus shown in FIGS. 1-4 includes a chassis or base 10, preferably in the form of a self propelled vehicle having wheels 12 or tracks, with a lift mechanism preferably in the form of a scissors mechanism 20 which may be of any suitable conventional construction. Alternatively, other forms of lift mechanisms such as articulated or telescoping booms are contemplated. As best seen in FIGS. 5 and 6, a typical scissors mechanism includes pivotally connected sets of left and right side scissors arms 22 which are generally centrally positioned over and in alignment with the longitudinal centerline C/L C of the chassis 10. The lowermost scissors arms 22 are connected at to a fixed pivot 14 and to a moveable pivot 14 which is linearly moved toward and away from the fixed pivot by a drive arrangement in the scissors mechanism 20 to extend and retract the arms as is conventional. A leveling link 24 is also shown in FIG. 4.

A work platform 30 of generally rectangular configuration having a deck 32, guard rails 34 and suitable controls 36 for use by an operator standing on the deck to elevate and position the work platform by driving the wheels 12 is also shown. The work platform has a longitudinally extending centerline C/L P shown in FIG. 5 and is firmly attached to the top of the lift mechanism.

Unlike conventional apparatus, the work platform 30 is attached to the top of the lift mechanism 20 in a laterally offset position such that the longitudinal centerline C/L P is spaced to the left of the longitudinal centerline C/L P as best seen in FIG. 5. When employing a scissors type lift mechanism as shown in the drawings, the work platform 30 may be conveniently supported at the upper end of the lift mechanism 20 through the use of spaced platform supports 26 pivotally connected to the tops of the scissors arms 22. The supports 26 include sliders 27 or rollers at the ends of the supports 26 which are in turn guided in tracks provided by spaced parallel structural channels at the bottom of the platform 30. The platform is thereby supported by contact of the lower surfaces of the upper flanges 28 of the channels with the sliders 27. Alternatively, if an articulated or telescopically extensible lift mechanism is employed, those skilled in the art will understand and readily devise suitable means as necessary to attach the platform in a laterally offset position relative to the lift mechanism 20.

A sheet rack 38 for handling relatively narrow and heavy loads such as panes of glass is preferably provided at one lateral side of the laterally offset rectangular work platform 30. It will be noted that the outermost lateral edge of the sheet rack preferably remains inside the vertically extended footprint of the chassis 10 including its wheels 12 such that the weight of the platform 30 and load thereon is substantially balanced over the chassis 10 and lift mechanism 20 unlike conventional centrally positioned work platforms.

Use of a laterally offset platform 30 to balance heavy loads such as panes of glass, also allows the most effective placement of counterweights on the chassis 10 thereby resulting in apparatus of lighter weight and lower cost.

An optional platform slide out platform deck extension 33 may also be provided for improving the productivity of the work.

Those skilled in the art will understand that various modifications of the preferred embodiments shown and described herein can be made without departing from the scope of the invention which is defined by the appended claims.

The invention claimed is:

1. A self propelled aerial work platform apparatus comprising:

a) a mobile chassis having a longitudinal centerline which extends in a first vertical plane;

b) a scissors lift mechanism having an upper end, and also having a lower end connected to said chassis; and c) a work platform supported at said upper end of said lift mechanism, said work platform having a longitudinal centerline which extends in a second vertical plane which is laterally spaced from and parallel to said first vertical plane and wherein the outermost extent of said chassis defines a first horizontal footprint and the outermost extent of said work platform defines a second horizontal footprint, a vertical projection of said second footprint being entirely within the boundary of said first footprint whereby said apparatus is moveable with said work platform in elevated position.

2. The apparatus of claim 1, wherein said work platform has a rectangular deck and guardrails at lateral sides of the deck equally spaced from said longitudinal centerline of said work platform.

3. The apparatus of claim 2, wherein said work platform has a sheet rack at one lateral side of said deck at substantially the same elevation as said deck.

4. The apparatus of claim 3, wherein said platform includes a sliding deck extension having guardrails.

5. A self propelled aerial work platform apparatus comprising:

a) a mobile chassis having a longitudinal centerline;

b) a scissors lift mechanism having an upper end and also having a lower end connected to said chassis in alignment with a longitudinal centerline of said chassis; and c) a generally rectangular work platform supported at an upper end of said scissors lift mechanism, said work platform having a longitudinal centerline laterally spaced from and parallel to a vertical plane which extends through said longitudinal centerline of said chassis such that the platform is laterally offset relative to said chassis and lift mechanism and wherein the outermost extent of said chassis defines a first horizontal footprint and the outermost extent of said work platform defines a second horizontal footprint, a vertical projection of said second footprint being entirely within the boundary of said first footprint whereby said apparatus is moveable with said work platform in elevated position.

6. The apparatus of claim 5, wherein said work platform includes a sheet rack at one lateral side of said platform at substantially the same elevation as said deck.

7. The apparatus of claim 5, wherein said mobile chassis comprises a wheeled vehicle.

8. The apparatus of claim 7, wherein said platform includes a sliding deck extension and guardrails.

9. A self propelled aerial work platform apparatus comprising:

a) a mobile chassis having a longitudinal centerline;

b) a scissors lift mechanism having an upper end and also having a lower end connected to said chassis in alignment with a longitudinal centerline of said chassis; and c) a generally rectangular work platform supported on an upper end of said scissors lift mechanism, said work platform having a longitudinal centerline laterally spaced from and parallel to a vertical plane which extends through said longitudinal centerline of said chassis and a sheet rack at one lateral side of said platform such that the platform is laterally offset relative to the chassis and lift mechanism and wherein the outermost extent of said chassis defines a first horizontal footprint and the outermost extent of said work platform and sheet rack defines a second horizontal footprint, a vertical projection of said second footprint being entirely within the boundary of said first footprint whereby said apparatus is moveable with said work platform in elevated position.

10. The apparatus of claim 9, wherein said mobile chassis comprises a wheeled vehicle.

11. The apparatus of claim 10, wherein said platform includes a sliding deck extension and guardrails.

12. The apparatus of claim 9 wherein said platform has a deck and said sheet rack is at substantially the same elevation as said deck.

* * * * *